United States Patent [19]

Cho

[11] Patent Number: 4,649,582

[45] Date of Patent: Mar. 17, 1987

[54] ADJUSTABLE SWEAT-ABSORBING PILLOW

[76] Inventor: Cheng-Hsiung Cho, No. 11-1, Lane 2, Kan Leh Street, Taichung, Taiwan

[21] Appl. No.: 806,916

[22] Filed: Dec. 9, 1985

[51] Int. Cl.[4] ..... A47C 20/02

[52] U.S. Cl. ..... 5/434; 5/437

[58] Field of Search ..... 5/434, 436, 437, 446, 5/447, 487, 490

[56] References Cited

U.S. PATENT DOCUMENTS

| | | | |
|---|---|---|---|
| 3,109,474 | 11/1903 | Levi | 5/490 |
| 3,174,163 | 3/1965 | Gibson | 5/437 |
| 3,242,511 | 3/1966 | Fultz et al. | 5/437 |
| 4,168,554 | 9/1979 | Hindes | 5/446 |
| 4,277,859 | 7/1981 | Slaman | 5/434 |
| 4,349,925 | 9/1982 | Macomber | 5/436 |

FOREIGN PATENT DOCUMENTS

| | | | |
|---|---|---|---|
| 23825 | of 1910 | United Kingdom | 5/490 |

*Primary Examiner*—Gary L. Smith
*Assistant Examiner*—Michael F. Trettel
*Attorney, Agent, or Firm*—Armstrong, Nikaido, Marmelstein & Kubovcik

[57] ABSTRACT

The present invention is an adjustable sweat-absorbing pillow comprising a pillow cover, a sweat cover and a pillow pad. The sweat cover and pillow pad are wrapped in the pillow cover such that the sweat cover lays between the pillow cover and the pillow pad to absorb heat and sweat. The pillow is easy to assembly and disassemble and is adjustable in height and softness.

3 Claims, 13 Drawing Figures

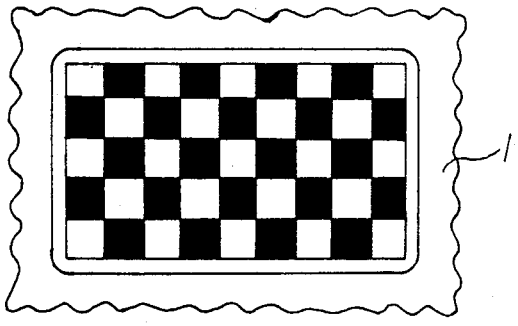
FIG. 1.1
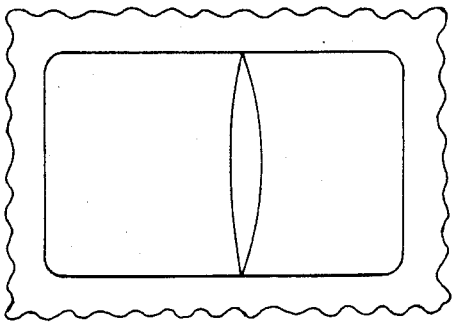
FIG. 1.2
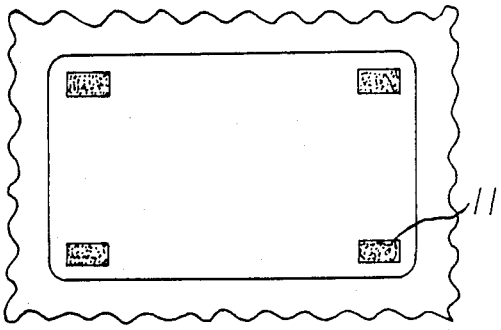
FIG. 1.3
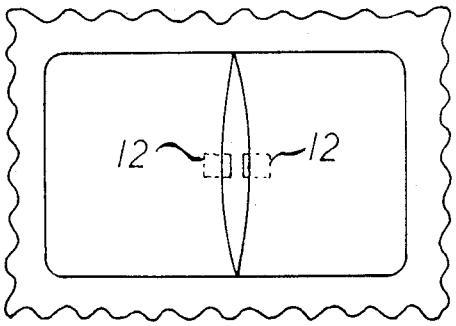
FIG. 1.4

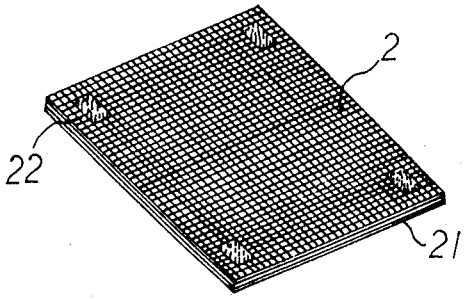
FIG.2.1
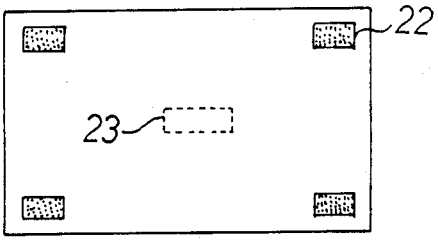
FIG.2.2
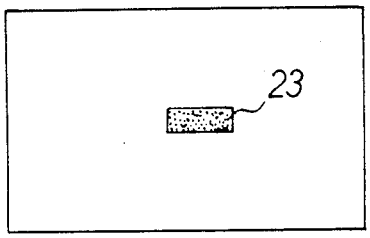
FIG.2.3
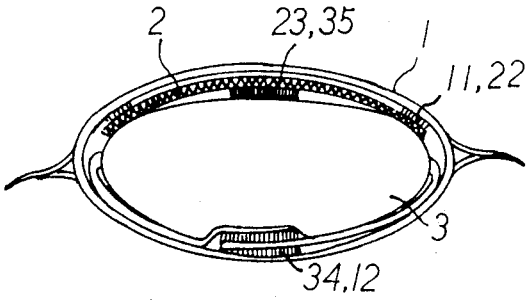
FIG.4

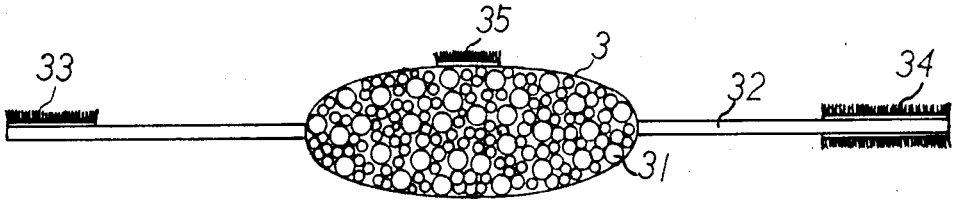
FIG.3.1
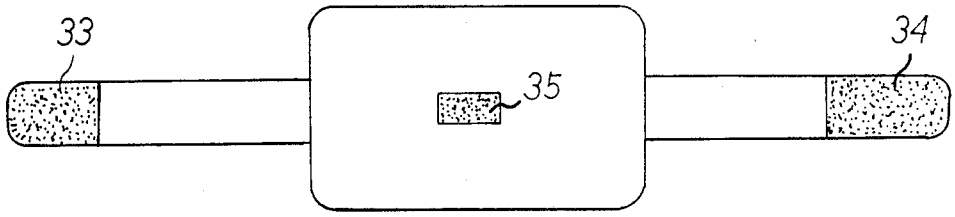
FIG.3.2
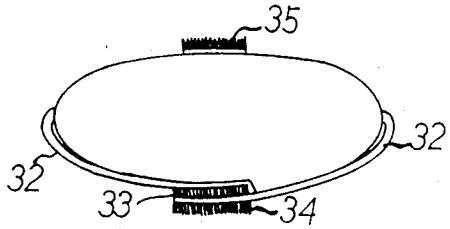
FIG.3.3
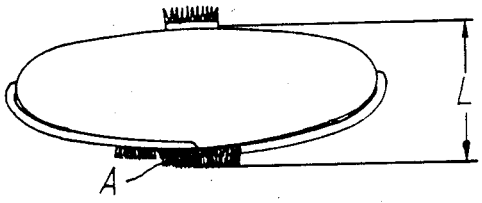
FIG.3.4
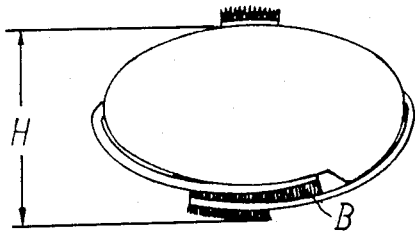
FIG.3.5

ADJUSTABLE SWEAT-ABSORBING PILLOW

FIELD OF THE INVENTION

An adjustable sweat-absorbing pillow, comprises a pillow cover, a sweat cover and a pillow pad. The sweat cover and pillow pad are wrapped in the pillow cover. The sweat cover is laid between the pillow cover and the pillow pad to absorb heat and sweat from the user's head. Any part of the pillow can be easily disassembled for washing. The pillow pad provides an adjustable height and softness to best suit different needs of all users and creates a comfortable feeling for the users.

BACKGROUND OF THE INVENTION

This invention provides a multi-functional pillow, and in particular, an absorbent, well-ventilated pillow that is adjustable in both height and softness.

Prior pillows often used include, first, rattan pillows which feel cool and are well-ventilated. However, pillows of this type are also hard and make the user feel uncomfortable. In addition, they can not be adjusted either in height or in shape to suit the physical needs of the users, and therefore, they are not used very much.

A second type of pillow are plastic pillows filled with straw. This type of pillow has no advantages but has numerous weak points: the straw pillows are hard and do not absorb sweat. In addition, they do not provide ventilation in any form, and therefore, they always make the user feel very uncomfortable. These pillows are the cheapest and the least desirable type of pillow.

A third type of pillow has a pillow cover filled with sponge or cotton. These pillows feel soft, and can be made to fit the physical shape of the user. However, these pillows are neither sweat-absorbing nor well-ventilated, and therefore, when used in the summer time, they feel bad. For the above-mentioned reasons, pillows of this kind are only suitable for use in high latitudes.

A fourth kind are pillows filled with fragrant pills or herbs. However, these pillows are not well-ventilated and are either too soft or too hard. In addition, sometimes the herb filling the pillow sticks out and hurts the user's head. Also, the pillow will become valueless when the herb smell is exhausted or if the pillow becomes mildewed.

A fifth kind of pillow is a pillow made by filling a pillow cover with green bead shells or dried tea leaves. This pillow provides good softness, but has the disadvantages of not being sweat-absorbing, being slack, mildewed and smelling bad.

SUMMARY OF THE INVENTION

The main purpose of this invention is to provide a pillow that is free of all the weak points mentioned above, and to provide a pillow with good air circulation and a sweat-absorbing feature. The pillow is designed to be adjusted to provide the most suitable height and softness for the user.

BRIEF DESCRIPTION OF THE DRAWINGS

FIG. 1.1 is the front view of the pillow cover.

FIG. 1.2 is the rear view of the pillow cover.

FIG. 1.3 is the top view of the inner side of the pillow cover.

FIG. 1.4 is the view of the inner bottom of the pillow cover.

FIG. 2.1 is the 3-dimensional view of the sweat cover.

FIG. 2.2 is the top view of the sweat cover.

FIG. 2.3 is the bottom view of the sweat cover.

FIG. 3.1 is the cross-section view of the pillow pad.

FIG. 3.2 is the top view of the pillow pad.

FIG. 3.3 is the view showing the belt of the pillow pad wrapping at the normal position.

FIG. 3.4 is the view showing the belt of the pillow pad wrapping at low position.

FIG. 3.5 is the view showing the belt of the pillow pad wrapping at high position.

FIG. 4 is a cross-section view of the assembled embodiment of the invention.

DESCRIPTION OF THE PREFERRED EMBODIMENT

FIG. 1. show the configuration of the invention. FIG. 1.1 and FIG. 1.2 are the front view and the rear view of the invention which are also seen in the conventional pillow covers. On the top surface of the inner side of the pillow cover (1), as shown in FIG. 1.3, there are 4 patches (11) stitched to the top surface.

FIG. 2. show the design configurations of the sweat cover. The sweat cover (2) as shown in FIG. 2.1, is made of layers of gauze or cotton cloth (21) that absorbs the heat or sweat from the user's head. The sweat cover is soft and provides good ventilation of air. There are 4 sticking patches (22) stitched on the four corners as shown in FIG. 2.2. A stitching patch (23) is stitched on the center of the bottom as shown in FIG. 2.3.

FIG. 3. show the pillow pad of the invention. The pillow pad (3) of the invention, as shown in FIG. 3.1, is filled with a hollow-core material (31) having adequate softness and good ventilation as well as being mildew-proof. A sticking patch (33) is stitched to the top surface of one end of the circular belt (32), and the other sticking patches (34) are respectively stitched to the top surface and the bottom surface of the other end. Also one sticking patch (35) is stitched to the center of the top surface of the pillow pad. To use the pillow, the user bends the two ends of the belt (32) of the pillow pad to the bottom surface, and connects the two ends together using the sticking patches (33) and (34) stitched thereon. FIG. 3.3 shows the pillow in a normal height position. To suit different needs of different people, high flexibility of both height and softness can be obtained by changing the engaged position of the two sticking patches attached to the ends of the belt as shown in FIG. 3.4 at point A, and FIG. 3.5 at point B. The outstanding features of this invention allows the users to obtain the softness and height that best suits their physical needs, making the pillow of the present invention a comfortable pillow for the users.

FIG. 4 shows a cross-sectional view of the pillow assembled. The outermost layer is the pillow cover (1); the middle layer is the sweat cover (2); and the bottom layer is the pillow pad (3). The pillow (1) and the sweat cover (2) are engaged with each other by the sticking patches (11) and (12) located at the four corners. The sticking patch (23) at the center of the bottom surface of the sweat cover (2) is engaged with the sticking patch (35) at the center of the top surface of the pillow cover (3). The sticking patch (34) at the bottom surface of the pillow pad (3) is engaged with the sticking patch (12) located at the bottom surface of the pillow cover. Thus, the assembled pillow provides not only close contact among the abovementioned parts but is also convenience when any of the parts need to be disassembled for washing.

In conclusion, the invention reveals an adjustable sweat-absorbing constructed pillow, which provides innovative and ideal functional to the users. The outstanding features of the invention include ventilativeness, absorptiveness, softness and wide adjustability to suit people having different requirements.

I claim:

1. An adjustable sweat-absorbing pillow means comprising:

a plurality of sticking patch means which are able to stick one to another;

pillow cover means including four corners, a top surface having an inner and outer side, and a bottom surface having left and right sides, wherein said sticking patch means are arranged on said four corners of said inner top surface and arranged on adjacent sides of said left and right sides of said bottom surface;

pillow pad means being filled with hollow grained material of various sizes, said pillow pad means being generally oval-shaped and having first and second sides opposite one another, wherein one sticking patch means is attached on the outer surface of said pillow pad means at the central portion thereof;

at least two belt means connected to said pillow pad means, wherein each of said belt means having first and second ends and having top and bottom surfaces, each of said first ends of said belt means being attached to respective opposite sides of said pillow pad means, one said belt means having said sticking patch means attached to said top surface of said second end of said belt means and said second belt means having two sticking patch means attached respectively to said top and bottom surfaces of said second end of said belt means; and sweat cover means being made of at least one layer of a heat and sweat-absorbing material means, said sweat cover means having four corners and having a top surface and a bottom surface, and wherein a plurality of sticking patch means are respectively attached to said four corners of said top surface and being attached to the center of said bottom surface, said sweat cover being arranged between said pillow cover means and said pillow pad means forming said adjustable sweat-absorbing pillow means such that said adjustable sweat-absorbing pillow means is adjustable in height and softness by modifying the engaging positions of said sticking patch means attached to said belt means of said pillow pad.

2. An adjustable sweat-absorbing pillow means according to claim 1, wherein said heat and sweat absorbing material means is gauze cloth.

3. An adjustable sweat-absorbing pillow means according to claim 1, wherein said heat and sweat absorbing material means is cotton cloth.

* * * * *